US005360060A

United States Patent [19]

Tanaka et al.

[11] Patent Number: 5,360,060

[45] Date of Patent: Nov. 1, 1994

[54] FIN-TUBE TYPE HEAT EXCHANGER

[75] Inventors: Takeo Tanaka, Ibaraki; Toshio Hatada; Masaaki Itoh, both of Tsuchiura; Takao Senshu, Shizuoka; Naoto Katsumata, Shimizu; Yoshihiko Mochizuki; Hirokiyo Terada, both of Shizuoka; Minetoshi Izushi; Minoru Sato, both of Shimizu; Hiromi Tsuji, Shizuoka; Makoto Nagai, Yaizu, all of Japan

[73] Assignee: Hitachi, Ltd., Tokyo, Japan

[21] Appl. No.: 986,702

[22] Filed: Dec. 8, 1992

[51] Int. Cl.[5] ..... F28D 1/04

[52] U.S. Cl. ..... 165/151; 165/181

[58] Field of Search ..... 165/151, 181, 182

[56] References Cited

U.S. PATENT DOCUMENTS

| | | | |
|---|---|---|---|
| 3,902,551 | 9/1975 | Lim et al. | 165/151 X |
| 4,300,629 | 11/1981 | Hatada et al. | 165/151 |
| 4,365,667 | 12/1982 | Hatada et al. | 165/152 |
| 4,593,756 | 6/1986 | Itoh et al. | 165/151 |
| 4,691,767 | 9/1987 | Tanaka et al. | 165/151 |
| 4,705,105 | 11/1987 | Cur | 165/151 |
| 4,715,437 | 12/1987 | Tanaka et al. | 165/151 |
| 4,791,984 | 12/1988 | Hatada et al. | 165/151 |
| 5,042,576 | 8/1991 | Broadbent | 165/151 |

FOREIGN PATENT DOCUMENTS

| | | | |
|---|---|---|---|
| 3508 | 1/1980 | Japan . | |
| 56-590 | 5/1981 | Japan | 165/151 |
| 6588 | 1/1986 | Japan . | |
| 252899 | 10/1989 | Japan | 165/151 |
| 71096 | 3/1990 | Japan | 165/151 |
| 115695 | 4/1990 | Japan | 165/151 |

*Primary Examiner*—John Rivell
*Assistant Examiner*—L. R. Leo
*Attorney, Agent, or Firm*—Antonelli, Terry, Stout & Kraus

[57] ABSTRACT

A fin-tube type heat exchanger has parallel heat transfer tubes and a stack of a plurality of plate fins mounted on the tubes. Heat exchange is conducted between a first fluid flowing through the tubes and a second fluid flowing through the stack across each of the fins. Each fin has flat tube-mounting portions spaced in the longitudinal direction of the fin and formed with tube-mounting holes and a louver section disposed between each adjacent pair of tube-mounting portions. The louver section has elongated slats extending longitudinally of the fin and having side edges each spaced from an adjacent side edge of an adjacent slat. The slats are classified into two groups in respect of the cross-sectional shape. The slats of one group have generally flat cross-sections to reduce the resistance of the fin to the flow of the second fluid through the stack and are disposed in planes offset from the plane of the tube-mounting portions. The slats of the other group have V-shaped or inverted V-shaped cross-sections to increase stiffness of the fin in the longitudinal direction thereof.

8 Claims, 22 Drawing Sheets

FIN-TUBE TYPE HEAT EXCHANGER

BACKGROUND OF THE INVENTION

1. Field of the Invention

The present invention relates generally to a heat exchanger applicable to an air conditioner or an industrial refrigeration unit and, more particularly, to a fin-tube type heat exchanger equipped with a stack of a plurality of heat transfer fins mounted on heat transfer tube groups in a heat exchanging relationship.

2. Description of the Prior Art

A fin of a conventional fin-tube type heat exchanger is provided with a multiplicity of slats generally referred to as a louver that are raised from the upper surface of fin. A performance is enhanced by making the slats contact with fresh air as much as possible. The contact of the slats with a great deal of fresh air is attained by reducing a boundary layer (strictly, temperature boundary layer) in which an air flow stays, by a decreasing widths of the slats or arraying downstream slats in proper positions such that the boundary layers formed upstream exert a less influence on the downstream slats. If the slat width is too reduced, forming of the fin becomes difficult. Utilized often is a method of improving the fin performance with a contrivance of the arrangement of slats. If the ideas of enhancing the fin performance depending upon the structure of louvers are the same, however, there can be seen considerably different ideas in configurations of the such as, for example, size, weight and air-flow resistance required concomitantly with the heat exchanger.

In order to reduce both size and weight of the fin, Japanese Patent Publication No. 59-26237 proposes a fin having, as shown in FIGS. 38 and 39, a bent configuration as viewed in a cross-section (taken in a direction of air flow). This fin has high stiffness in the lengthwise direction of the fin because the slats of the louver are bent. The fin, therefore, presents a less deformation even if the fin plate is made of a thin sheet metal. Thus, the louver can be disposed in a proper position; however, the air flow is, disturbed due to V-shaped slats of the louver. There exists a possibility of increasing the air-flow resistance in a high air velocity area. It is therefore desirable that the fin be designed for use with a low air velocity.

Namely, the bent fin can be termed as a low-deformation and high-performance fin suited to a low air velocity. On the other hand, as shown in FIGS. 40 and 41, Japanese Unexamined Patent Publication No. 61-6588 discloses a fin advantageous to a reduction in air-flow resistance, wherein plural pairs of slats having different shapes as viewed in sections taken along longitudinal direction of the louver are arranged in the direction of the air flow (the fin based on this structure is called an "accordion fin"). This fin does not disturb the air flow because the slats of the fin are planar as viewed in a section taken along the air-flow direction. The air-flow resistance is therefore low even at the high air velocity. In this fin, however, V-shaped means or the like for increasing the longitudinal stiffness are not provided in the louver. The fin therefore tends to be deformed in the longitudinal direction thereof. In such elongated fins the number of heat transfer tubes arranged in the longitudinal direction of the fin is large, the entire fin tends to be flexed to cause a possibility that the tube pitch deviates from a design value. Consequently, it is difficult to stack and convey the fins and, consequently, the accordion fin is limited to a short fin with a relatively small amount of deformation.

In the above-described fins of the prior art, the louver is deformed differently in different parts of the fins. Influences exerted on the fin performance are correspondingly different in different parts of the fins. Further, the velocity of air flowing between the adjacent fins of the fin-tube type heat exchanger is not uniform while the air flows across the widths of the fins and because the air flow results in a contraction flow and an expansion flow depending on the existence of pipes.

Then, for preventing a decline of the performance due to the deformation of the louver, there arises a problem that the slats in the portion subjected to a less deformation and having no necessity for enhancing the stiffness are bent with a resultant increase in the air-flow resistance. Reversely, when the louver is constructed of only the slats having a planar configuration, a problem is also caused that fabrication and workability of the fin are reduced due to lack of the fin stiffness.

SUMMARY OF THE INVENTION

The present invention aims at providing a fin-tube type heat exchanger equipped with fins capable of exhibiting high stiffness, a high performance of heat transfer and a small air-flow resistance that can not be obtained based on a single slat configuration, by combining slats having a high performance of heat transfer and slats having a small air-flow resistance even at a high air velocity, i.e., a plurality of slats showing different properties.

It is a primary object of the present invention to provide a heat exchanger equipped with fins exhibiting high stiffness, a high performance of heat transfer and a small air-flow resistance.

Another object of the present invention resides in providing a heat exchanger having two types of slats having different properties, i.e., slats having a high performance of heat transfer and slats having a small air-flow resistance even at a high air velocity to provide a merit that can not be obtained from a fin having a louver including the slats exhibiting the same property.

A further object of the present invention resides in providing a plate fin for a heat exchanger which accomplishes the above noted objects.

According to the present invention, there is provided a fin-tube type heat exchanger comprising at least two substantially parallel heat transfer tubes, and a stack of a plurality of heat transfer fins mounted on the tubes in a heat transferring relationship, with each heat transfer fin including at least two tube-mounting sections substantially flat and substantially parallel with a first plane substantially perpendicular to axes of said heat transfer tubes. At least one louver section integrally connected with the two tube-mounting sections and having at least one portion positioned between the two tube-mounting sections, and with a tube-mounting hole formed in each tube-mounting section. The heat transfer tubes extend respectively through the tube-mounting holes, with a heat exchange being effected between a first fluid flowing through the heat transfer tubes and a second fluid flowing through said stack across said fins. The louver section includes a plurality of elongated slats extending substantially in parallel with a line connecting the axes of the two heat transfer tubes and has side edges separated from each other. The slats comprise a first slat group in which each slat has a planar configuration substantially parallel with the first plane, as viewed in a cross-section taken along a second plane perpendicular to the line connecting the axes of said two heat transfer tubes and also perpendicular to the first plane and at least one second slat group in which each slat has a non-planar configuration as viewed in said cross-section. The planar slat group includes a plurality of slats, with the non-planar slat group includes at least one slat. A slat of the non-planar slat group has a cross-sectional configuration to increase stiffness of the fin in a direction of a line connecting the axes of said two heat transfer tubes.

In accordance with the present invention, both ends of each slat of the planar slat group are integrally connected with the two tube-mounting sections, with each adjacent pair of slats of the planar slat group having sectional configurations different from each other, as viewed in longitudinal sections taken along third planes parallel to the line connecting the axes of the two heat transfer tubes and perpendicular to the first plane, whereby the efficiency of heat transfer of the fin is improved. Hence, the non-planar slats increase the stiffness of the fin, while the planar slats enhance the efficiency of heat exchange of the fin.

According to a further feature of the present invention, there is provided a fin-tube type heat exchanger comprising at least two substantially parallel heat transfer tubes, and a stack of a plurality of heat transfer fins mounted on said tubes in a heat transferring relationship, with each heat transfer fin including at least two tube-mounting sections spaced from each other. At least one louver section is integrally connected with the two tube-mounting sections and has at least one portion positioned between said two tube-mounting sections, and a tube-mounting hole is formed in each tube-mounting section. The heat transfer tubes extend respectively through the tube-mounting holes, with a heat exchange being effected between a first fluid flowing through the heat transfer tubes and a second fluid flowing through the stack across said fins, wherein the louver section has a plurality of elongated slats extending substantially in parallel with a line connecting the axes of the two heat transfer tubes and having the edges separated from each other; said fin has a wavy configuration as viewed in a cross-section taken along a first plane perpendicular to the line connecting the axes of said two heat transfer tubes and parallel to said axes; the slats remote from the top and bottom of the wavy cross-section have planar configurations substantially parallel to a second plane perpendicular to the axes, as viewed in the cross-section; the slats near the top and bottom of the wavy cross-section have non-planar configurations in the cross-section; and each of said non-planar slats has a cross-sectional configuration to increase the stiffness of said fin in the direction of the line connecting the axes of said two heat transfer tubes.

In accordance with still further features of the present invention, there is provided a fin-tube type heat exchanger comprising at least two substantially parallel heat transfer tubes, and a stack of a plurality of heat transfer fins mounted on the tubes in a heat transferring relationship, with each heat transfer fin including at least two tube-mounting sections spaced from each other. At least one louver section is integrally connected with said two tube-mounting sections and has at least one portion positioned between said two tube-mounting sections. A tube-mounting hole is formed in each tube-mounting section, with the heat transfer tubes extending respectively through said tube-mounting holes. A heat exchange is effected between a first fluid flowing through the heat transfer tubes and a second fluid flowing through the stack across the fins, wherein said louver section has a plurality of elongated slats extending substantially in parallel with a line connecting the axes of the two heat transfer tubes and having side edges separated from each other. The louver section includes a first portion included within an area of the heat transfer tubes projected in the direction of the line connecting the axes of the heat transfer tubes and at least one second portion positioned outwardly of said projected area; said first section includes a plurality of slats each having a planar sectional configuration substantially parallel to a first plane perpendicular to the axes, as viewed in a cross-section taken along a second plane perpendicular to the line connecting the axes of said two heat transfer tubes; said second portion includes a plurality of slats each having a non-planar configuration as viewed in the cross-section; and each of said non-planar slats has a cross-sectional configuration to increase the stiffness of said fin in the direction of the line connecting the axes of said two heat transfer tubes.

In the heat exchangers according to the second and third aspects of the present invention, the non-planar slats also increase the stiffness of the fin, while the planar slats enhance the efficiency of heat exchange.

According to a fourth aspect of the present invention, there is provided a plate fin for a heat exchanger having at least two heat transfer tubes, comprising: at least two tube-mounting sections formed with tube-mounting holes for receiving said heat transfer tubes; and at least one louver section connected integrally with said two tube-mounting sections and having at least one portion positioned between said two tube-mounting sections; said louver section having a plurality of elongated slats extending substantially in parallel with a line connecting the axes of the two tube-mounting holes and has side edges separated from each other. The slats comprise a first slat group in which each slat has a planar configuration substantially parallel with a first plane perpendicular to the axes as viewed in a cross-section taken along a second plane perpendicular to the line connecting the axes of the two tube-mounting holes and at least one second slat group in which each slat has a non-planar configuration as viewed in cross-section. The planar slat group includes a plurality of slats with the said non-planar slat group including at least one slat, and with the slat of the non-planar slat group has a cross-sectional configuration to increase the stiffness of the fin in the direction of the line connecting the axes.

According to still further feature of the present invention, there is provided a plate fin for a heat exchanger having at least two heat transfer tubes, comprising at least two tube-mounting sections spaced from each other and formed with tube-mounting holes for receiving the heat transfer tubes, and at least one louver section integrally connected with the two tube-mounting sections and having at least one portion positioned between the two tube-mounting sections. The louver section has a plurality of elongated slats extending substantially in parallel with a line connecting the axes of the two tube-mounting holes and has side edges separated from each other. At least the louver section has a wavy configuration as viewed in a cross-section taken along a first plane perpendicular to the line connecting the axes of said two tube-mounting holes. The slats remote from the top and bottom of the wavy cross section has planar configurations substantially parallel to a second plane perpendicular to the axes, as viewed in the cross-section. The slats nearest to the top and bottom of the wavy cross-section have non-planar configurations in cross section, and the non-planar slats have cross-sectional configurations to increase the stiffness of the fin in the direction of the line connecting the axes.

According to the present invention, there is provided a plate fin for a heat exchanger having at least two heat transfer tubes, comprising, at least two tube-mounting sections spaced from each other and formed with tube-mounting holes for receiving said heat transfer tubes, and at least one louver section connected integrally with the two tube-mounting sections and having at least one portion positioned between said two tube-mounting sections. The louver section has a plurality of elongated slats extending substantially in parallel with a line connecting the axes of the two tube-mounting holes and has side edges separated from each other; said louver section includes a first portion positioned between the two tube-mounting sections and at least one second portion positioned at the side of said first portion. The first portion includes a plurality of slats each having a planar sectional configuration substantially parallel to a first plane perpendicular to the axes, as viewed in a cross-section taken along a second plane perpendicular to the line connecting the axes of the tube-mounting holes. The second portion includes a plurality of slats each having a non-planar cross-sectional configuration as viewed in the cross-section, with the non-planar slats having cross-sectional configurations to increase the stiffness of the fin in the direction of the line connecting the axes of said two tube-mounting holes.

In accordance with the present invention, the non-planar slats also increase the stiffness of the fin, while the planar slats contribute to an improvement in the efficiency of heat exchange.

The above and other objects, features and advantages of the present invention will become more apparent from the following description with reference to the accompanying drawings.

DESCRIPTION OF THE PREFERRED EMBODIMENTS

Figure 6:
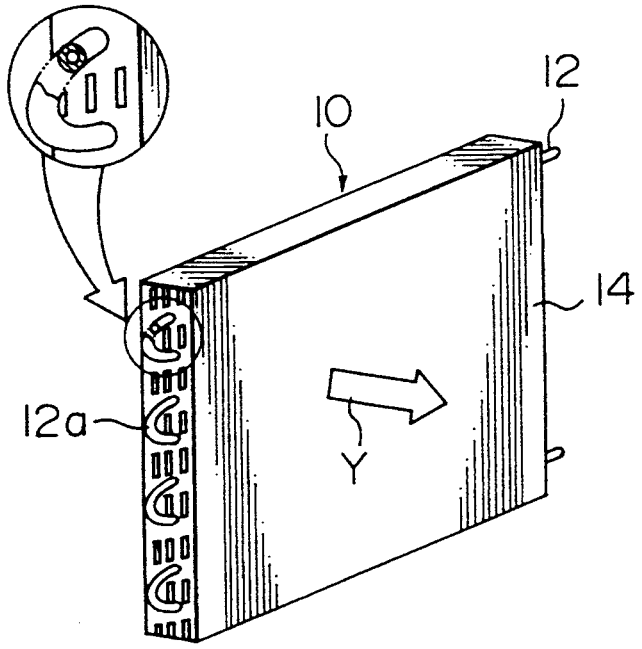
FIG. 6 is a perspective view of a heat exchanger including plate fins of the first embodiment of the present invention.

Referring first to FIG. 6, in accordance with the present invention, a fin-tube type heat exchanger 10 includes a zig-zag heat transfer tube 12 through which a first fluid flows and a stack 14 of a plurality of heat transfer fins mounted on the tube 12 in a heat transferring relationship. A second fluid such as, e.g., air, flows through the fin stack 14 in an arrowed direction Y in FIG. 6. At this time, the second fluid flows in contact with the respective fins, thus effecting a heat exchange with the first fluid flowing through the heat transfer tube 12. In the illustrative embodiment, the single heat transfer tube 12 has a plurality of parallel sections extending zig-zag through the interior of the fin stack 14. The adjacent tubular sections are connected to each other by U-shaped elbows 12*a* outside the stack 14. According to this specification and appended claims, however, for a descriptive convenience, each tubular section is called a "tube".

Figure 1:
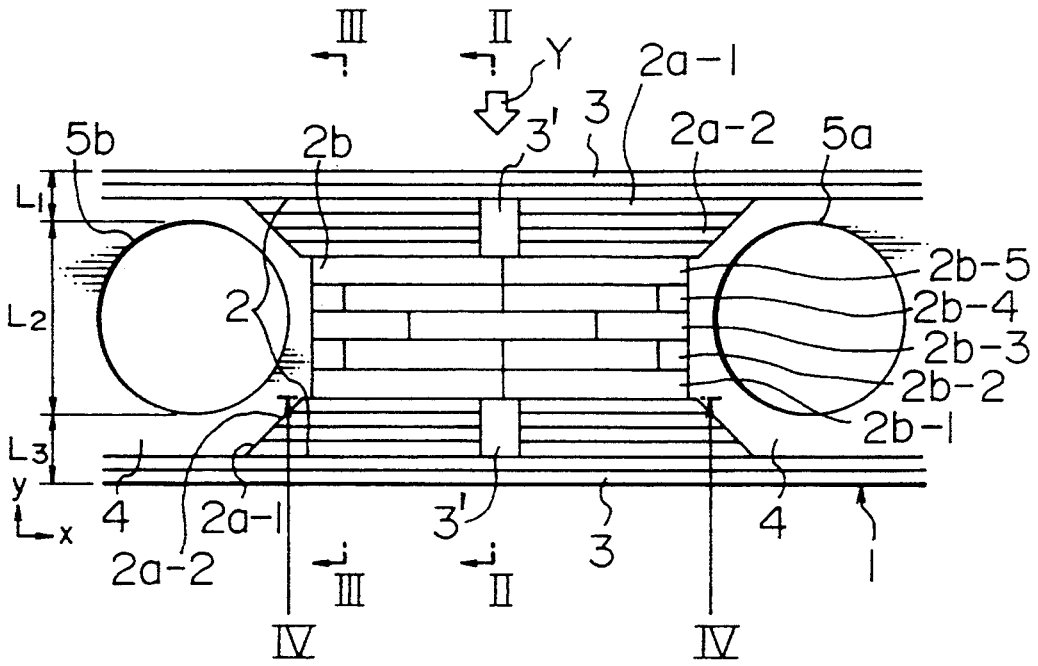
FIG. 1 is a fragmentary plan view of a plate fin of a first embodiment of the present invention.

As shown in FIG. 1, each heat transfer fin 1 includes at least two tube-mounting sections 4 substantially flat and parallel with a first plane (defined by an x-axis and a y-axis) substantially perpendicular to the axes of the heat transfer tubes 12, at least one louver section 2 disposed between and integrally connected to the two tube-mounting sections 4, and tube-mounting holes 5*a*, 5*b* formed in these tube-mounting sections 4. The heat transfer tubes 12 extend through the tube-mounting holes 5*a* and 5*b*, respectively. Each tube-mounting section 4 extends beyond the diameter L2 of the tube-mounting hole in a widthwise direction (y-axis direction) of the fin. The tube-mounting section 4 also extends in the longitudinal direction of the fin beyond the diameter of the tube-mounting hole. The width of the fin 1 is equal to the sum of the diameter L2 of the tube-mounting hole and dimensions L1 and L3 of side edge sections 3 added to both ends of the diameter L2.

Figure 2:
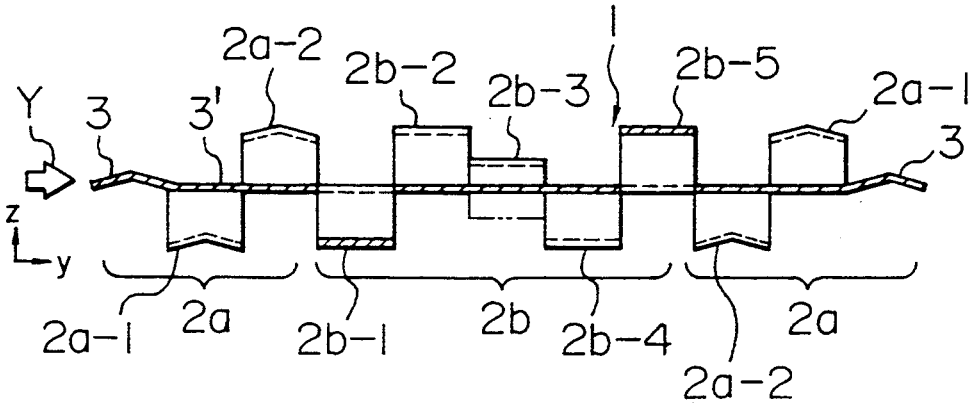
FIGS. 2 and 3 are enlarged cross-sectional views taken along the lines II—II and III—III in FIG. 1, respectively.
Figure 3:
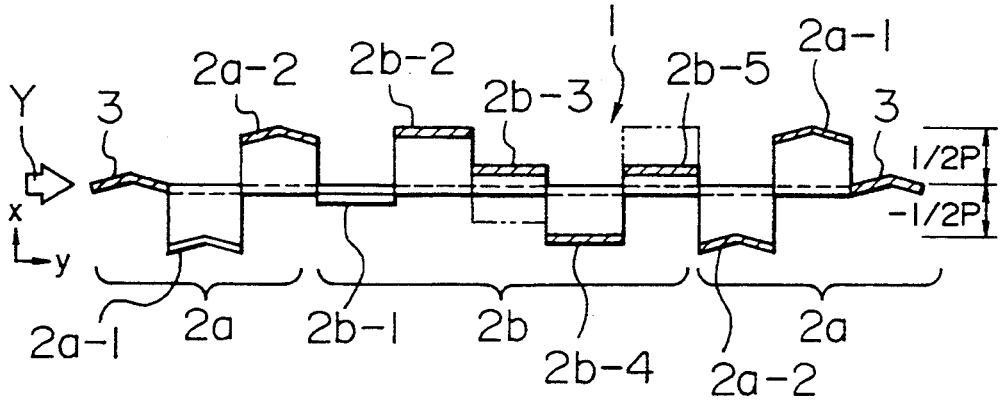

As apparent from FIGS. 1–3, the fin 1 assumes a symmetric configuration with respect to a line connecting the axes of two adjacent heat transfer tubes 12. The louver section 2 has a plurality of elongated slats extending substantially in parallel with the line (x-axis direction) connecting the axes of the two adjacent heat transfer tubes 12 and having side edges separated from each other. These slats comprise a first slat group 2*b* in which each slat has a planar configuration and is substantially parallel with the first plane (indicated by in FIG. 4A), as viewed in a cross-section taken along a second plane (including y-axis and z-axis) perpendicular to the line connecting the axes of the two heat transfer tubes 12 and also perpendicular to the first plane; and second slat groups 2*a* in which each slat has a non-planar configuration and are positioned on both sides of the slat group 2*b*. Flat sections 3' extending in the same plane as those of the tube-mounting sections 4 are provided at the central parts of the non-planar slat groups 2*a* as viewed in the longitudinal direction of the fin, thus separating each of the slat groups 2*a* into two segments. The two separated slat group segments respectively include two slats 2*a*-1 and 2*a*-2. The planar slat group 2*b* includes a plurality of slats 2*b*-1 through 2*b*-5. The slats 2*a*-1 and 2*a*-2 of each non-planar slat group 2*a* assume an inverted V-shape in cross-section to increase the stiffness of the fin in the direction (x-axis direction) of the line connecting the axes of the two heat transfer tubes.

Two side edges of the louver section 2 are adjacent to the side edge sections 3 of the fin 1. The side edge sections 3 are connected integrally with the opposite side edges of each tube-mounting section 4. These two side edge sections 3 also assume an inverted V-shape in cross-section, thereby increasing the stiffness of the fin 1 in the longitudinal direction (the direction x) thereof.

In accordance with the present invention, as illustrated in FIG. 1, both ends of each slat of the planar slat group 2*b* are connected integrally with the two flat tube-mounting sections 4. As shown in FIG. 4A, the slats of the planar slat group 2*b* assume configurations protruding by a dimension $\frac{1}{2}$P on both sides from the first plane (Zo) perpendicular to the axes of the heat transfer tubes 12, as viewed in a longitudinal section parallel to a third plane (including the x-axis and the z-axis) perpendicular to the first plane and parallel to the line connecting the axes of the two heat transfer tubes 12. The dimension P is the interval between each adjacent pair of fins in the fin stack 14 shown in FIG. 6, i.e., a fin pitch. As shown in FIG. 4A, each adjacent pair of slats in the planar slat group 2*b* take longitudinal sectional configurations different from each other. Hence, the slat group 2*b* assumes a pattern shown in FIG. 4 when the planar slat group 2*b* is viewed from the front surface (from the line VI—VI in FIG. 1). This pattern is the same when the slat group 2*b* is seen in an arrowed direction Y in FIG. 1, i.e., in the direction of the flow of the second fluid such as air. This implies an increase in the degree of contact between the fin and the second fluid flowing across the fin 1. Therefore, an efficiency of heat exchange of the fins is improved.

The slats of the non-planar slat groups 2*a* and the side edge sections 3 of the fin 1 serve to enhance the stiffness of the fin 1, and the slats of the planar slat group 2 enhance the efficiency of heat exchange of the fin.

Obtaining a high heat transfer rate of louver involves making the slats fine. At the same time, it is required that the downstream slats take such proper positions and configurations as to lessen the influence of boundary layers caused by the upstream slats. In other words, the downstream slats should preferably be positioned and configured to contact fresh air flow to the greatest possible degree. If the slats are thin however, the stiffness of the slats tends to decline, and the slats are easily deformed. It is therefore difficult to set the slats in the above-mentioned proper positions and configurations.

In the fin-tube type heat exchanger for an air conditioner, a multiplicity of slats each having a thickness of 0.1–0.2 mm are arranged within a fin pitch as narrow as only about 2 mm so as not to overlap with each other as viewed in the direction Y of the flow of the second fluid. For this reason, a slight deformation in the protruding direction (direction Z) of the slat from the reference plane Zo exerts a serious influence to the performance of heat transfer. Deformations of louvers are mainly caused when the louvers are formed by press working and when the tubes are expanded into close contact with fins. Further, the deformation of the louver is not necessarily caused in the entire fin. Particularly, it has been found from a photo of a section of a fin that large deformations are caused locally at both side edges of the fin.

The presumed reason is that fin areas of both side edge sections of the fin, which serve as free ends when the tubes are expanded are so small that no reaction force is strong enough to cancel a force applied from the heat transfer tubes than in the other portions of the fin. The force is therefore exerted to the fin one-sidedly from the tubes being expanded. It is therefore important to keep the proper louver position so as to increase the stiffness of the fin by some method and, especially, to minimize the deformations of the side edges of the fin. For this reason, the louver configuration at the two side edges of the fin of the present invention is such that the V-shaped slats 2a-1, 2a-2 are, as shown in FIGS. 2 and 3, disposed at only the side edges of the fin. Lengths of these slats are set less than or equal to a half of the pitch of the interval between two adjacent heat transfer tubes 12. Further, as shown in FIG. 1, the short slats 2a-1 and 2a-2 adjacent in the longitudinal direction of the fin are integrally interconnected by flat sections 3' disposed at the center of the interval between the heat transfer tubes so that the stiffness of the fin is increased. The construction described above is effective to suppress the deformation of fins at both side edges and prevent overlapping of the downstream slats with the upstream ones as viewed in the arrowed direction Y.

Note that attention has to be paid to prevent a gas flow ("blow-by") without contacting the slats concomitantly with deformations of louvers at the central parts of fins. The heat transfer tubes exist in the fin-tube type heat exchanger and, therefore, a contraction flow and expansion flow of gas between the tubes are essentially inevitable. Namely, the inflow gas indicated by the arrow Y in FIG. 1 decreases in velocity because of a large passage area at the front edge of the fin. In the central part of the fin, however, the passage area is narrowed by the heat transfer tubes 12, and the flow of the gas is therefore accelerated to a high velocity. The gas passage area is again enlarged downstream of the central part of the fin with smallest distance between the adjacent heat transfer tubes. The flow of the gas is thereby decelerated. The rate at which the gas flow velocity changes is more conspicuous with a larger diameters of the heat transfer tubes 12 and a smaller tube pitch. In this connection, the air flow velocity turns out to be approximately 1.5 times or twice at both side edges of the fin and at the central part thereof in the case of the fin-tube type heat exchanger for air conditioners.

In the conventional fin-tube type heat exchanger, slits are formed in each fin at points as closer as possible to each adjacent pair of heat transfer tubes in an attempt to increase the heat transfer performance of the fin. Accordingly, configurations of the slats raised by the slits adjacent the heat transfer tubes are more complicated than those of the fins disposed at central zone between the heat transfer tubes. There is an inherent tendency, therefore, that flow of gas is concentrated to the central zone between the two adjacent heat transfer tubes. If the gas flow passage area in the central zone is enlarged due, for example, to localized deformation of the central slats, more gas is concentrated to a localized part of the gas flow passage adjacent the central zone between the two adjacent heat transfer tubes to greatly increase the velocity of the gas flow at the central zone. It is to be noted that the slats at the central zone are remote from the heat transfer tubes and thus do not contribute to heat transfer so much even if the slats are contacted by the high velocity gas flow, with a result that heat exchanging performance of the heat exchanger is greatly lowered.

Prevention of the high-velocity flow at the center of the interval between the heat transfer tubes is achieved by dividing the passage into a plurality of small sub-passages and preventing such a non-uniformity that the passage resistance increases only in the vicinity of the heat transfer tubes. Thus, in accordance with this embodiment, as illustrated in FIG. 4A, a combination 2b (called an "accordion louver") of a plurality of slats is disposed at the central part of the tube interval, the slats assuming different configurations as viewed in longitudinal sections (taken in the x-axis direction) of the fin 1. When this combination 2b of slats is viewed in the direction of the arrow Y, the passage is finely divided, as illustrated in FIG. 4.

Figure 4:
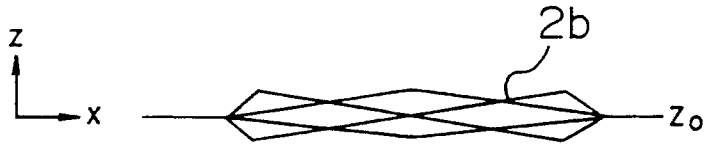
FIG. 4 is a front elevation of a louver central part as viewed along the line IV—IV in FIG. 1.
Figure 4A:
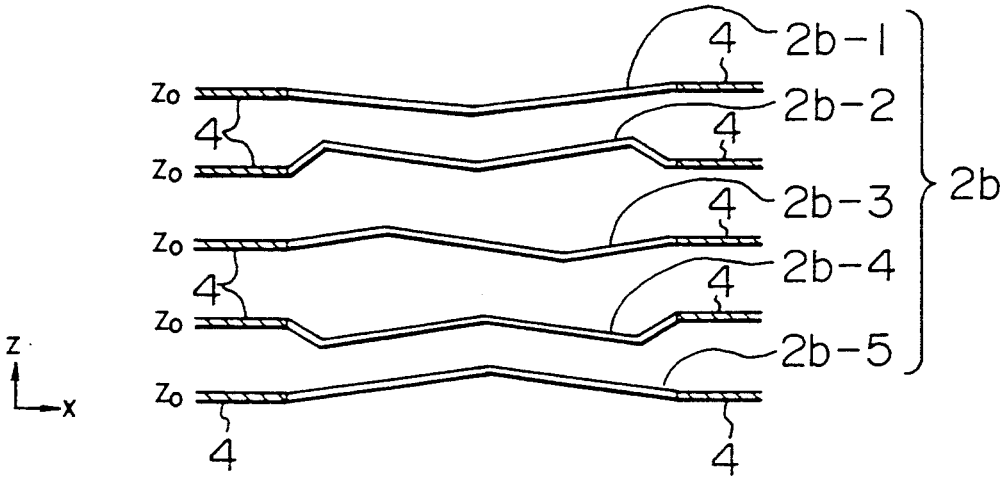
FIG. 4A is an enlarged front elevation illustrating respective slats of the louver central part shown in FIG. 4 with the positions of their reference planes shifted in the vertical direction.
Figure 5:
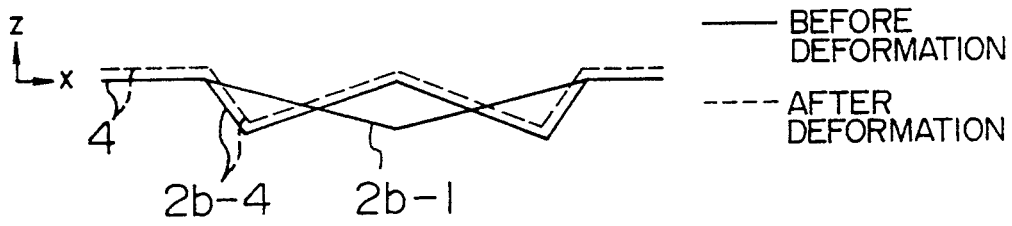
FIG. 5 is an enlarged front elevation of slats, illustrating deformations of the slats of the louver central part.

The arrangement of the slats shown in FIG. 4 is capable of not only preventing the occurrence of high-velocity flow at the center of the interval between the two heat transfer tubes but also reducing the overlaps of the temperature boundary layers caused due to deformations of upstream slats. FIG. 5 illustrates the deformation of the slats of which the boundary layers are readily overlapped with each other, e.g., the downwardly bent slats 2b-1 and 2b-4 shown in FIG. 4A. The slats generally tend to be deformed in the vertical direction from the fin reference plane Zo. In the accordion louver, however, the above-mentioned slats 2b-1 and 2b-4 have such configurations as to intersect each other. Hence, even if a deformation occurs, the overlap of the boundary layers is limited to the intersections of two slats. Namely, in the accordion louver, even when the slats are deformed, the heat transfer performance is not decreased, but rather a stable performance is exhibited.

The description has been concentrated so far to the performance of heat transfer; however, in the great majority of cases, an air-flow resistance is also an extremely important factor in the fin-tube type heat exchanger. For reducing the air-flow resistance according to the present invention, the cross-section of each of the slats of the slat group 2b at the central part of the fin is planar and parallel (the attack angle is zero) to the air flow Y at any point between two adjacent tubes, as shown in FIGS. 2 and 3. The air-flow resistance is proportional to a square of the flow velocity. Hence, as discussed above, the slat group 2b is effective to reduce the air-flow resistance in the portion where the passage is narrow to increase the flow velocity. The slat configuration of the slat group 2b is reasonable, accordingly. Further, the slat groups 2a enhance the stiffness of the fin and lessen the flexure of the entire fin. Hence, the problem that the stacking operation of the fins is caborious because of a deviation of the tube pitch between a plurality of fins is advantageously solved by the present invention.

Figure 7:
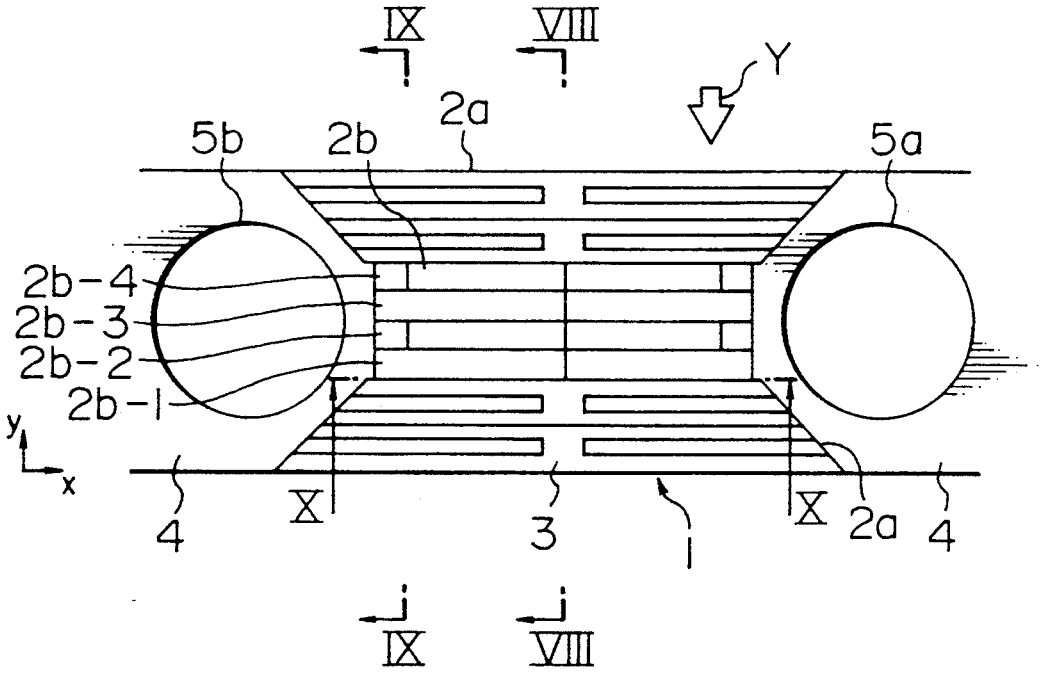
FIG. 7 is a view similar to FIG. 1 but shows a second embodiment of the fin according to the present invention.
Figure 8:
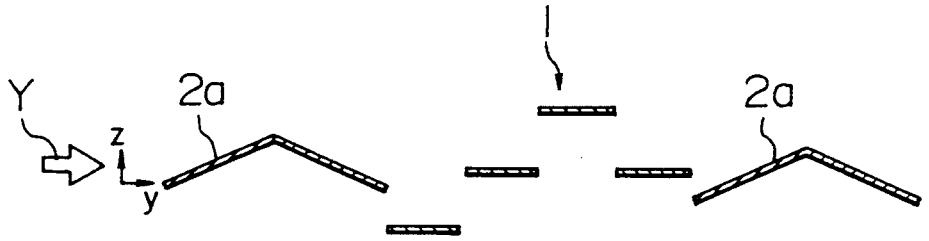
FIGS. 8 and 9 are enlarged cross-sectional views taken along the lines VIII—VIII and IX—IX in FIG. 7.
Figure 9:
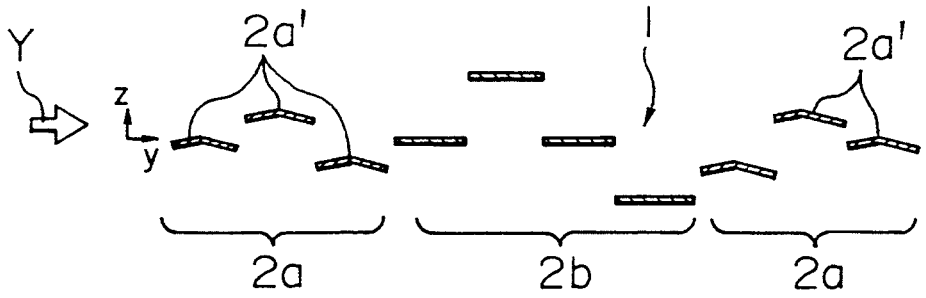
Figure 10:
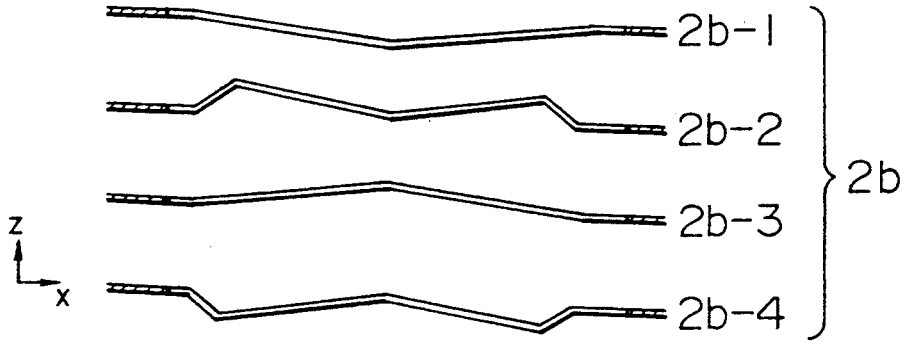
FIG. 10 is a front elevation similar to FIG. 4A, illustrating configurations of the respective slats of the louver central part.

In the embodiment of FIGS. 7–10, the slats 2*a* in both side edges of the fin assume, as illustrated in FIG. 8, an inverted V-shape in cross-section. Slits extending in the longitudinal direction are formed in both longitudinal ends of these slats 2*a* to divide the slat end portions into a plurality of small inverted V-shaped slats 2*a*40 as shown in FIG. 9. The louver configurations excepting this point are basically the same as those in the embodiment discussed above.

When the performance is to be enhanced by reducing the slat width, the embodiment of FIGS. 7–10 is effective to increase the stiffness of the fin. From the view point of workability, it is difficult to secure a large gap between the small slats 2*a*′ in the slat groups 2*a*. The downstream slats tend to undergo the influence of the temperature boundary layers. The slat width can be reduced in the embodiment of FIGS. 7–10 and, thus, the performance of the same degree as that of the preceding embodiment can be obtained.

Figure 11:
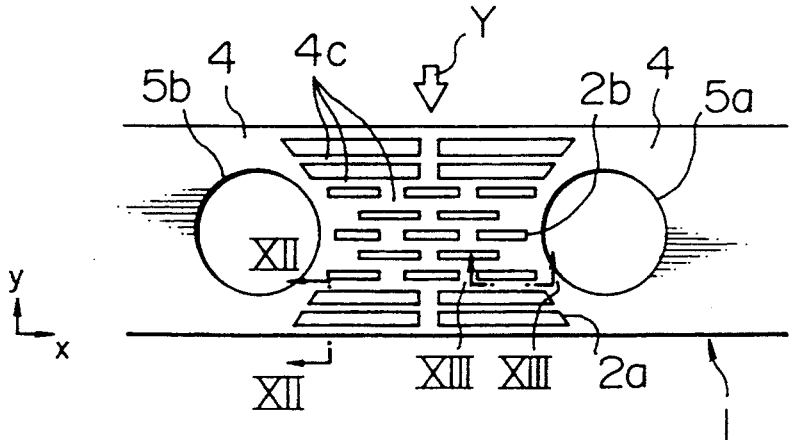
FIG. 11 is a view similar to FIG. 1 but shows a third embodiment of the fin according to the present invention.
Figure 12:
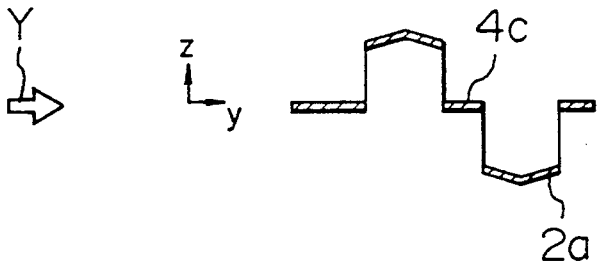
FIG. 12 is a fragmentary enlarged sectional view of the louver taken along the line XII—XII in FIG. 11.
Figure 12A:
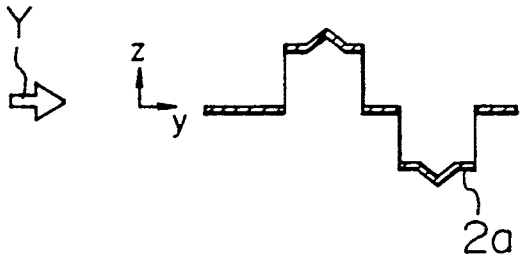
FIGS. 12A–12C are views each illustrating a modification to the sectional configuration shown in FIG. 12.
Figure 12B:
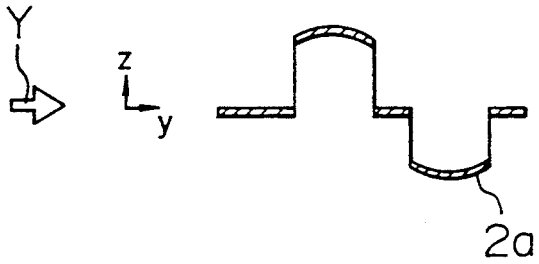
Figure 12C:
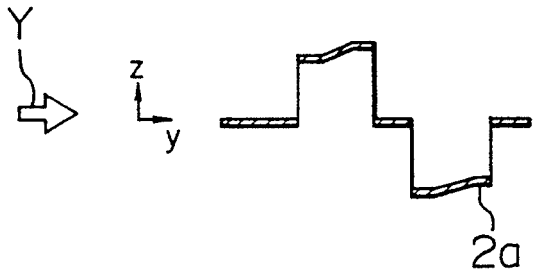
Figure 13:
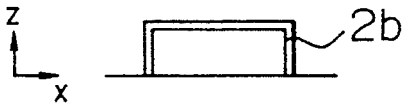
FIG. 13 is a fragmentary enlarged front elevation of the louver slat taken along the line XIII—XIII in FIG. 11.
Figure 13A:
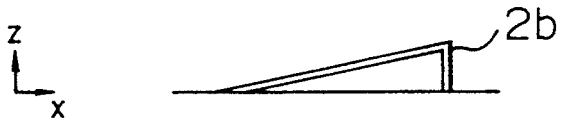
FIGS. 13A–13D are views each illustrating a modification to the slat configuration shown in FIG. 13.
Figure 13B:
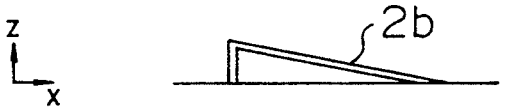
Figure 13C:
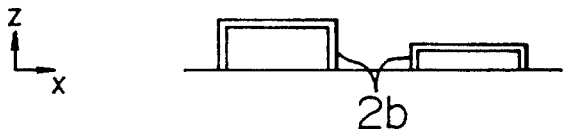
Figure 13D:
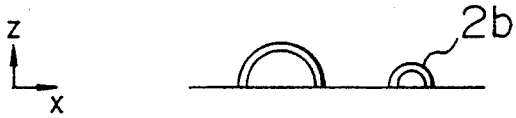

FIGS. 11 through 15 illustrate a third embodiment of the present invention and modifications thereof. FIG. 12 shows a section of a part of the slat 2*a* adjacent one side edge of the slat 2*b*. The sections of the louver at both side edges of the fin in accordance with this embodiment take a configuration which increase the stiffness of the fin in the longitudinal direction. FIGS. 12A to 12C show modifications to the configuration shown in FIG. 12. These configurations are characterized in that any louver has an attack angle to the air flow. In contrast with this, the slat 2*b* in the center of the fin takes a variety of configurations such as rectangle, triangle, semi-circular shape, etc. as viewed in the arrowed direction Y, as shown in FIGS. 13 through 13D. However, the cross-sectional configuration of each of these slats is flat and does not have the attack angle to the air flow Y.

Disposed alternately in this embodiment, as illustrated in FIG. 11, are raised slats 2*a* and 2*b* and flat sections 4*c* extending in the same plane as the planes of the tube-mounting sections 4. These slats are discontinuous in the direction Y. The slats are, however, grouped into non-planar slat groups at both side edges of the fin and a planar slat group at the central part of the fin. Incidentally, while an illustration is not omitted, the same configuration as the above-mentioned slat configuration may be given to the flat sections 4*c*.

Figure 14:
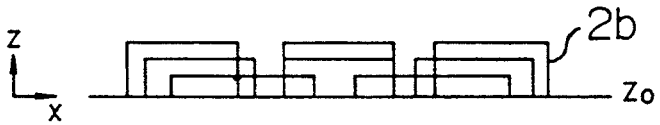
FIG. 14 is an enlarged front elevation similar to FIG. 4, illustrating the louver central part of the fin shown in FIG. 11.
Figure 14A:
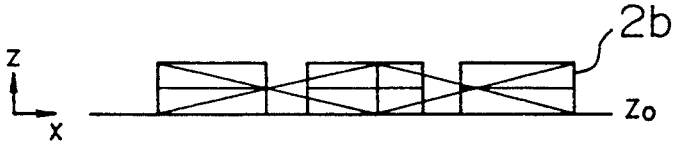
FIGS. 14A and 14B are schematic views each showing a modification to the louver structure shown in FIG. 14.
Figure 14B:
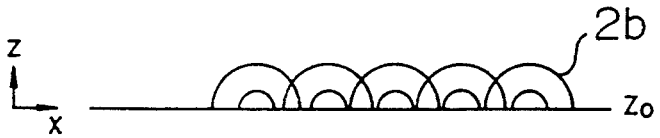
Figure 15:
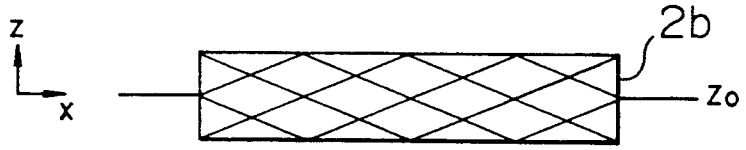
FIG. 15 is a schematic view showing another modification to the louver structure shown in FIG. 14.
Figure 15A:
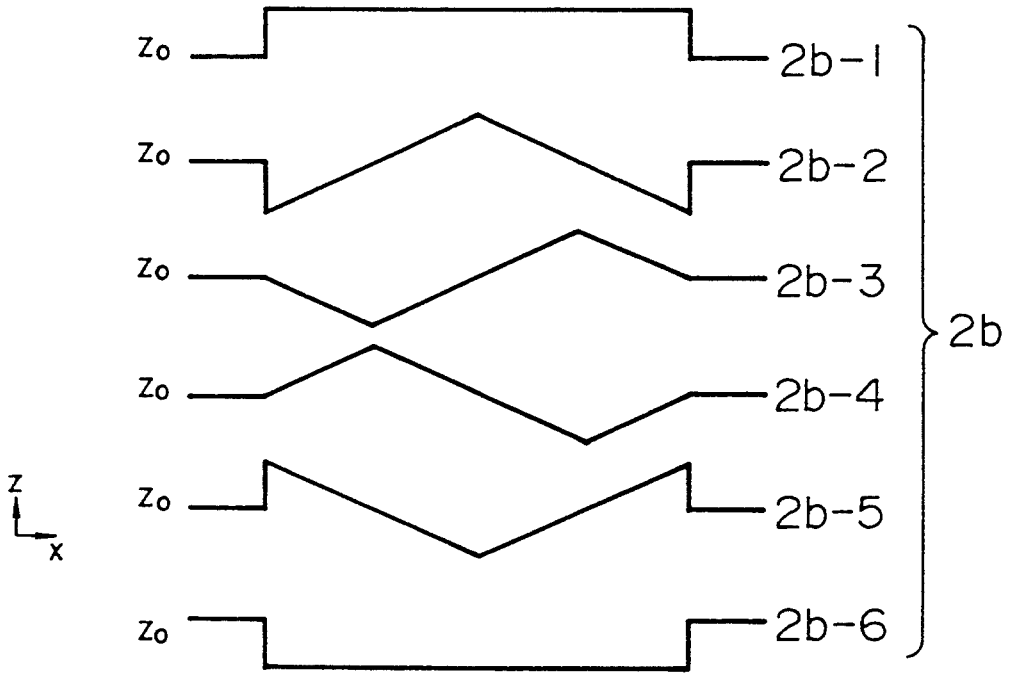
FIG. 15A is a view similar to FIG. 4A, illustrating the configurations of respective slats of the louver shown in FIG. 15.

For overcoming defects inherent to the planar slats with which the overlaps of the slats are easily caused due to deformation, in accordance with this embodiment, as depicted in FIG. 11, the length of each slat in the fin central part is one-half or one-third of that of the slat in other embodiments. Deformation of the planar slats is thus reduced. On the other hand, for preventing the high-velocity flow at the fin central part, the passage configuration as viewed from the upstream side (in the direction Y) of the fin is varied such that the sectional configurations of the slats in the longitudinal direction and the heights thereof are varied within the height range from the reference plane Zo to the fin as shown in FIGS. 14–15A. The air-flow resistance within the passage is thereby made uniform. FIG. 14 shows an example of combination of the rectangular slats of FIG. 13. FIG. 14A illustrates an example of combination of rectangular and triangular slats of FIG. 13A to 13C. FIG. 14B illustrates an example of combination of the semicircular slats of FIG. 13D. Fluid passages of various configurations are thus formed.

FIGS. 15 and 15A illustrate other embodiments of the louver configuration in the central part of the fin according to the present invention. FIG. 15A shows, similar to FIG. 4A, a slat group 2*b* in the fin central part. The overlaps of the boundary layers in the slat group 2*b* as viewed from the upstream side of the fin-tube type heat exchanger are, as illustrated in FIG. 15, less than those of the slats in the central parts of the embodiments of FIGS. 4, 14 and 14B by due to combination of six kinds of slats 2*b*-1 through 2*b*-6. A high performance is thereby attainable.

Figure 21:
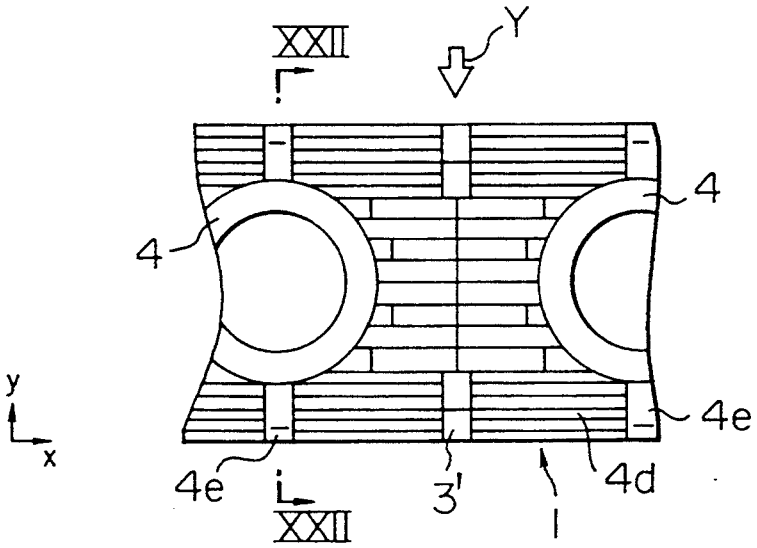
FIG. 21 is a view similar to FIG. 1 but shows a fifth embodiment of the fin according to the present invention.
Figure 22:
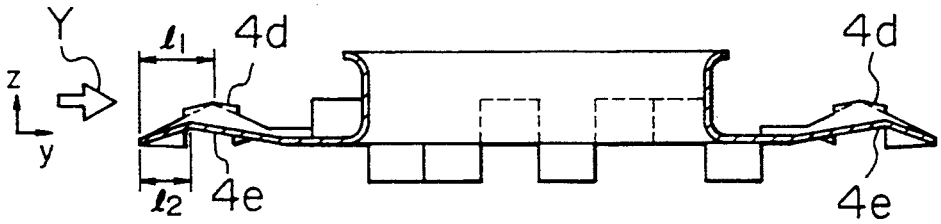
FIG. 22 is an enlarged cross-sectional view taken along the line XXII—XXII in FIG. 21.
Figure 23:
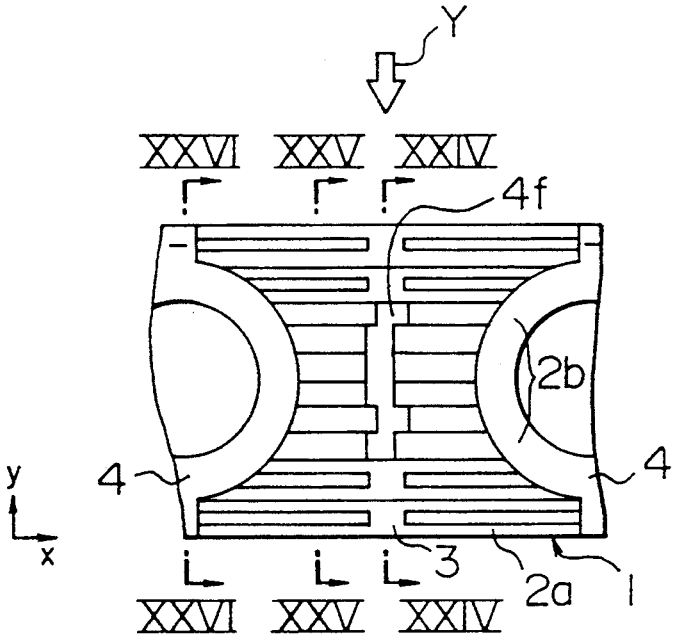
FIG. 23 is a view similar to FIG. 1 but shows a sixth embodiment of the fin according to the present invention.
Figure 24:
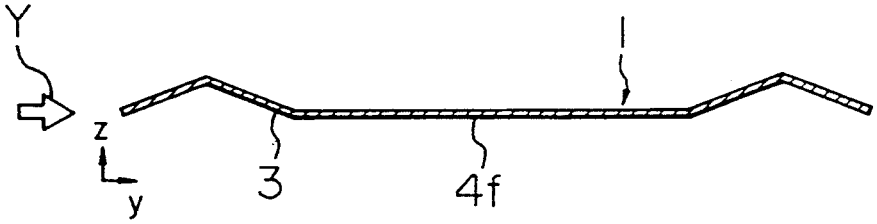
FIGS. 24, 25 and 26 are enlarged cross-sectional views taken along the lines XXIV—XXIV, XXV—XXV and XXVI—XXVI in FIG. 23, respectively.

The fin configuration of the embodiment of FIGS. 16–20 is substantially the same as that of the embodiment of FIG. 7 except that bent sections 4*e* are provided between both side edges of the fin and the tube-mounting sections 4. The side edge portions of the fin are thus provided with inverted V-shaped sections 4*d*, 3′ and 4*e* having different heights $h_1$, $h_2$ and $h_3$ as viewed in cross-section taken in the direction y. The two sections 4*d* and 4*e* have the same distance measured from the both side edges of the fin to the peaks of the inverted V-shaped cross-sections. Further, as shown in FIGS. 21 and 22, the fin 1 may be designed such that the distances from the V-shaped peaks of the sections 4*d* and 4*e* to the side edges of the fin are different, as expressed by $l_1$ for the section 4*d* and $l_2$ for the section 4*e*.

The side edge portions of the fin are provided with the bent sections 4*d* and 4*e* to enhance the stiffness of the fin as a whole. There exists, however, a possibility that flexures are caused in both side edge portions of the fin due to the force exerted to the fin by the heat transfer tubes during the tube expansion process conducted to fit the tubes into the tube fitting holes in fins. Independent bent (V-shaped cross-section) sections may be provided longitudinally in the fin to absorb such flexures to thereby increase the stiffness of the entire fin.

Figure 25:
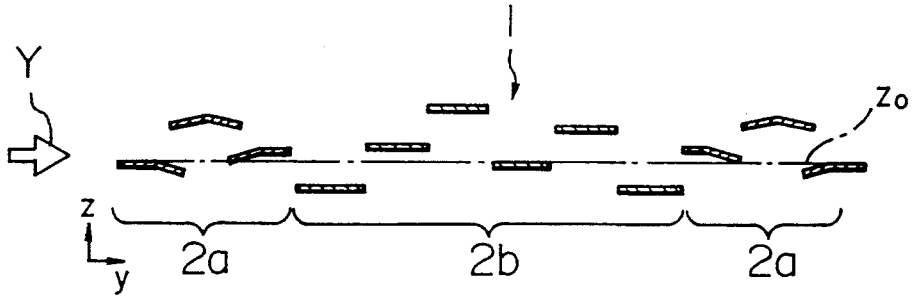
Figure 26:
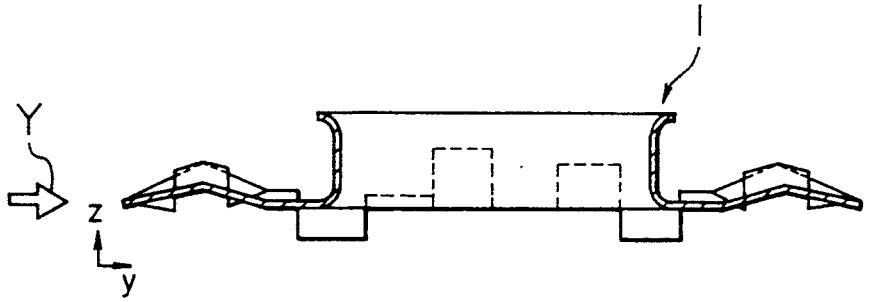

The embodiment of FIGS. 23–26 is substantially the same as the embodiment of FIG. 1 except that a plurality of slats 2*b* protrude in the vertical directions (direction z) from the reference plane Zo, the slats 2*b* being provided in the fin central part substantially in parallel with the direction of flow Y, as illustrated in FIG. 25.

The slats in the central part of the fin are formed by providing the fin with a plurality of cuts shorter than the interval between two adjacent heat transfer tubes arranged in the longitudinal direction (the direction x) of the fin and by offsetting the slats from the reference plane Zo of the fin. A flat section 4*f* with no notch is provided to extend in the flowing direction y in the central part of the fin between two heat transfer tubes. Both ends of this flat section 4*f* are connected to central portion of inverted V-shaped fin side edge sections 3. The slats each having a short length are connected to the opposite sides of the flat sections 4*f* and the tube mounting sections 4. In this manner, all the slats disposed between two adjacent heat transfer tubes are connected to the flat section and central portions of the side edge sections 4*f* and 3 having no slit therein. The stiffness of the fin 1 is thereby increased.

Figure 27:
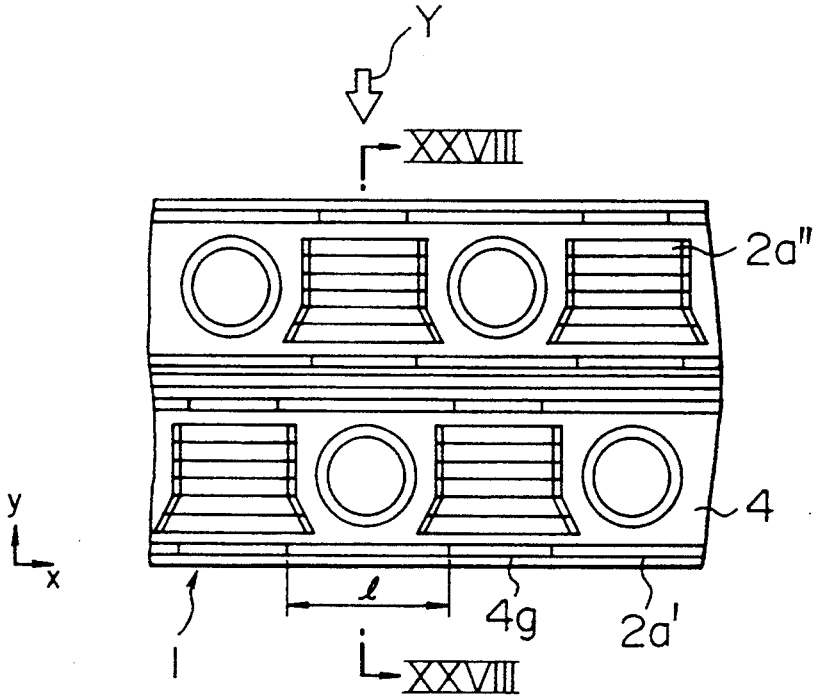
FIG. 27 is a view similar to FIG. 1 but shows a seventh embodiment of the fin according to the present invention.
Figure 28:
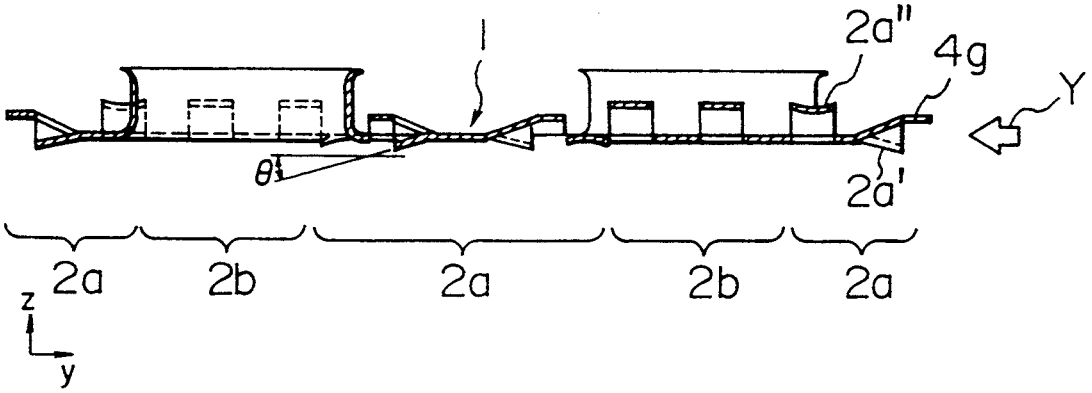
FIG. 28 is an enlarged cross-sectional view taken along the line XXVIII—XXVIII in FIG. 27.
Figure 29:
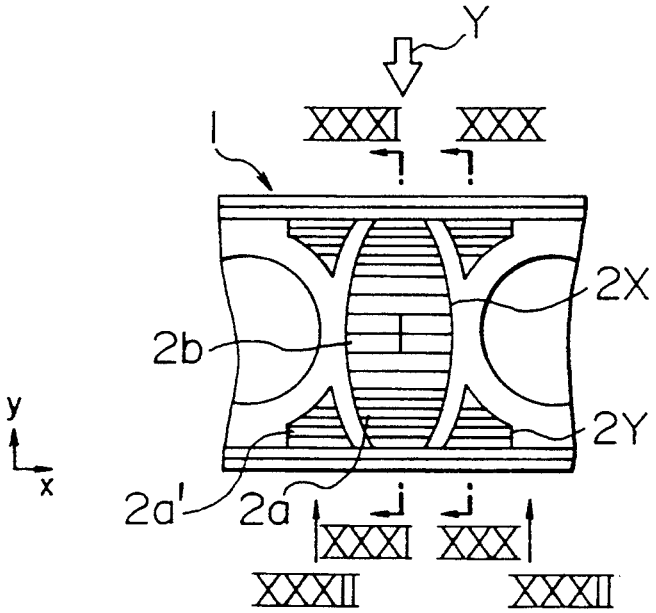
FIG. 29 is a view similar to FIG. 1 but shows an eighth embodiment of the fin according to the present invention.
Figure 30:
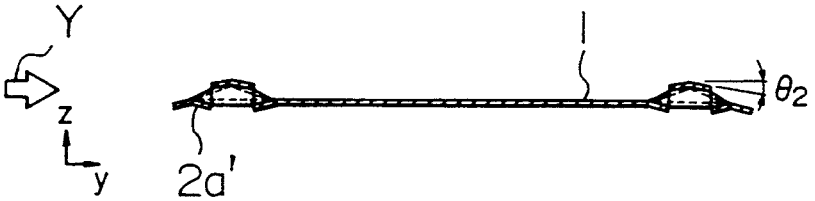
FIGS. 30 and 31 are enlarged cross-sectional views taken along the lines XXX—XXX and XXXI—XXXI in FIG. 29, respectively.

In the embodiment of FIGS. 27 and 28, a fin 1 includes a slat group 2*b* consisting of substantially planar slats parallel with the direction of flow Y and disposed in the fin central part interposed between two adjacent heat transfer tubes arranged in the direction (the direction x) perpendicular to the flow direction Y, and non-planar slat groups 2a positioned upstream and downstream of this slat group 2b in the flow direction Y. The non-planar slat groups 2a each include a slat 2a' formed by partially cutting a bent edge section 4g and a louver 2a'' raised from the reference plane of the fin. In the embodiment of FIGS. 27 and 28, the stiffness is increased by employing the non-planar slat groups 2a and by bending the fin. The length l of the cut in each fin edge section 4g and the bending angle $\theta$ of the slat 2a' may be suitably selected to assure that the air flow is smoothly guided and the heat transfer performance is enhanced by reducing a residence of the fluid downstream of the heat transfer tubes.

In the embodiment of FIGS. 29 through 32, the fin assumes a wavy configuration in cross section in the part of the fin between two adjacent heat transfer tubes arranged longitudinally of the fin. Disposed at the central part of the fin is a slat group 2x including a plurality of planar slat groups 2b and a plurality of inverted V-shaped non-planar slat groups 2a positioned upstream and downstream thereof. Side slat groups 2y each consisting of a plurality of non-planar slats 2a' extending in the direction x are provided adjacent the central slat group 2x. The bending angle $\theta_1$ of each slat 2a in the central slat group 2x is set to be greater than the bending angle $\theta_2$ in the side slat groups 2y. The blow-by of the air flow at the central zone of the fin between adjacent heat transfer tubes is thereby prevented.

Figure 31:
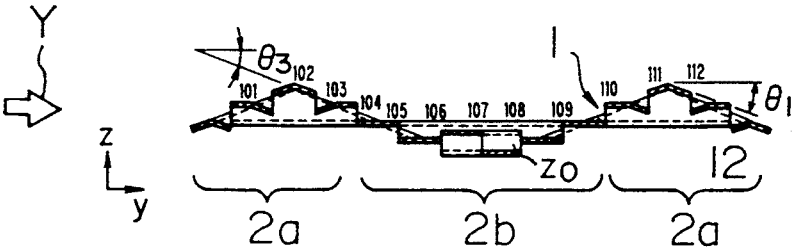
Figure 32:
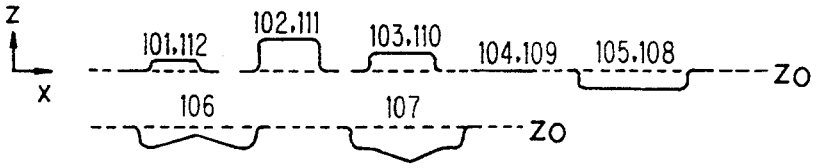
FIG. 32 is an enlarged front elevation of a fin edge taken along the line XXXII—XXXII in FIG. 29.

Such fin design has an inherent problem that, if the bending angle $\theta_1$ of each slat 2a of the central slat group 2x is increased too much in an attempt to prevent the blow-by of the air flow, dead air zones are formed downstream of upstream non-flat slats 2a, so that the planar slats 2b disposed downstream of the central slat group 2x are placed in such dead air zones, with a result that the heat transfer performance of the entire fin is lowered. As the dead air zones are formed substantially parallel to the reference plane Zo of the fin, the planar slats 2b should preferably be of different longitudinal sectional configurations and combined as in the combination shown in FIG. 4A. If, however, it is desired from the view point of productivity to reduce the type of the shapes of the slats and thus reduce the number of stamping molds to be used, the bending angle $\theta_3$ of the wavy cross-sectional configuration of the entire fin may be selected to be large enough to provide a sufficient gap between each adjacent pair of planar slats 2b, as shown in FIG. 31, such that only the slats which cannot be prevented from inevitably falling within dead air zones, such as the slats 106 and 107 shown in FIG. 32, are so shaped as to intersect the reference plane Zo, to thereby assure that the fin has a high stiffness, is capable of preventing the blow-by of air flow and the overlaps of slats and provides a high heat transfer performance.

Figure 33:
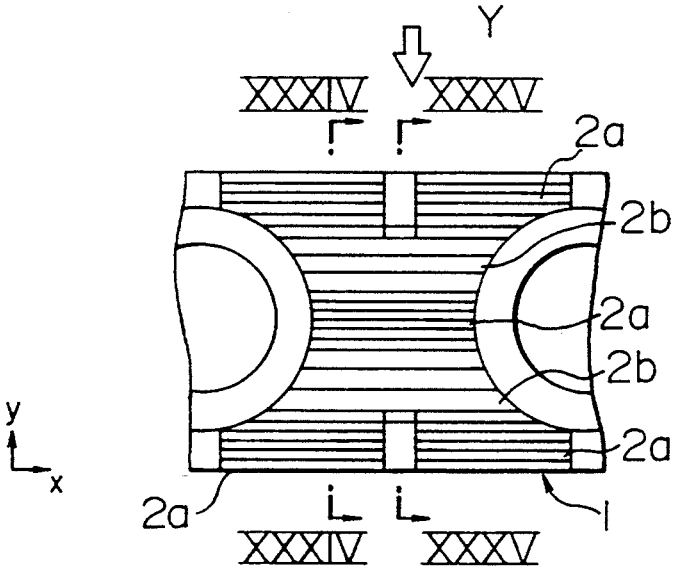
FIG. 33 is a view similar to FIG. 1 but shows a ninth embodiment of the fin according to the present invention.
Figure 34:
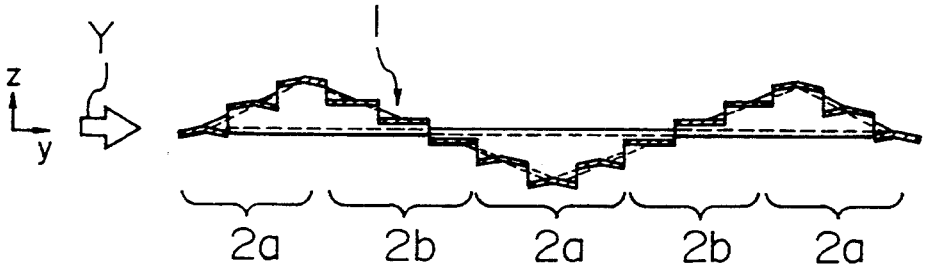
FIGS. 34 and 35 are cross-sectional views taken along the lines XXXIV—XXXIV and XXXV—XXXV in FIG. 33, respectively.
Figure 35:
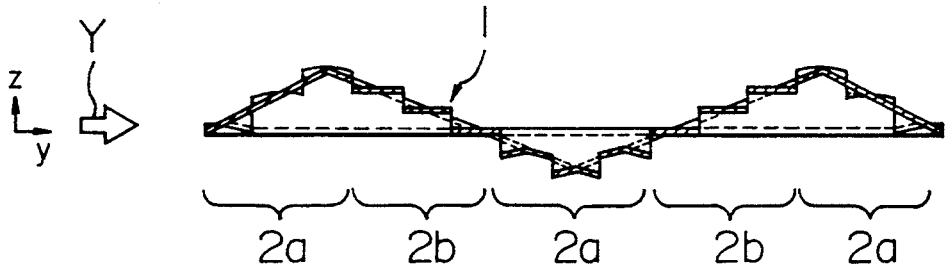

In the embodiment of FIGS. 33 to 35, the fin 1 takes a wavy configuration in cross-section. A plurality of non-planar slats 2a are disposed in the vicinity of the tops and bottom of the wavy cross-section. Planar louvers 2b parallel to the flow direction Y are respectively disposed in other positions. The non-planar slats 2a are also disposed in both side edges of the fin. These slats 2a are separated from each other by cuts shorter than the interval between the adjacent heat transfer tubes arranged in the direction (direction x) perpendicular to the flow direction Y. In the embodiment of FIGS. 33–35, since the fin assumes a wavy configuration in cross-section and the non-planar slats 2a are employed, the stiffness of the fin is higher than in other embodiments. As a result, the embodiment of FIGS. 33–35 is effective especially to prevent the occurrence of deformation of a fin having a small thickness.

Figure 16:
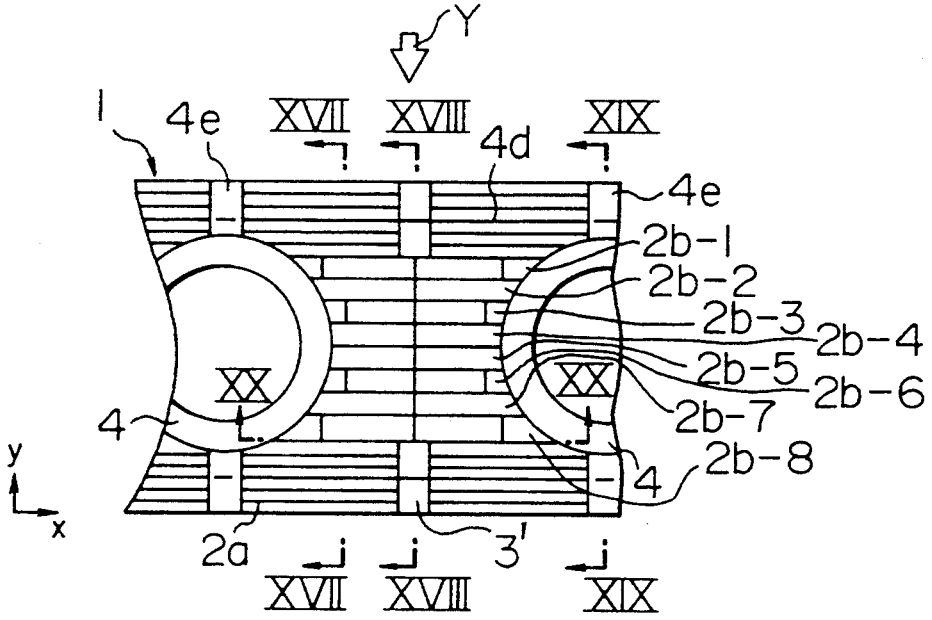
FIG. 16 is a view similar to FIG. 1 but shows a fourth embodiment of the fin according to the present invention.
Figure 17:
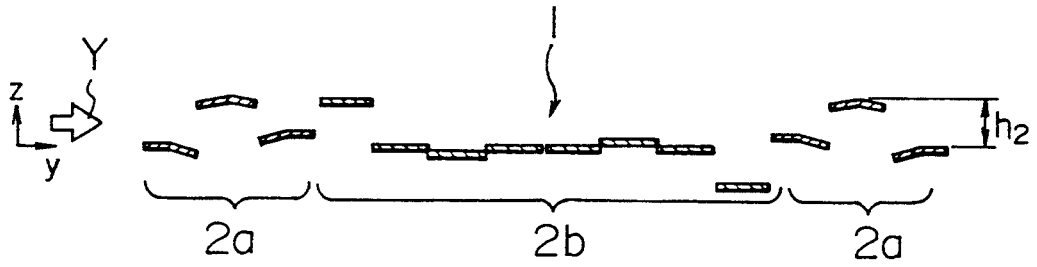
FIGS. 17–19 are enlarged cross-sectional views taken along the lines XVII—XVII, XVIII—XVIII and XIX—XIX in FIG. 16, respectively.
Figure 18:
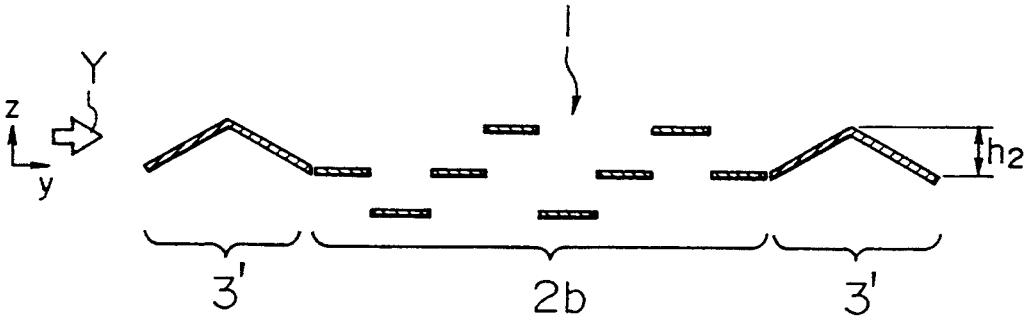
Figure 19:
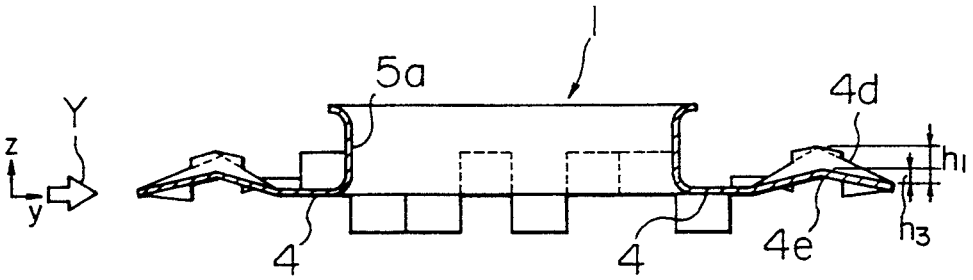
Figure 20:
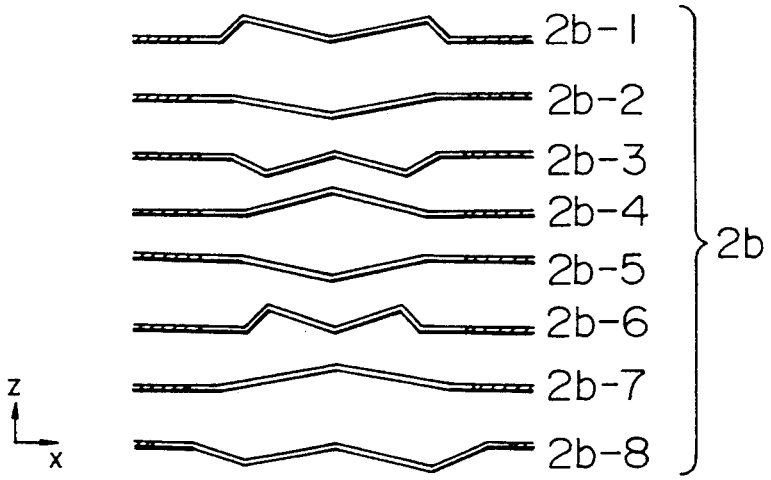
FIG. 20 is a view similar to FIG. 4A, illustrating the configurations of the respective slats of the louver central part of the fin shown in FIG. 16.

The embodiment of FIGS. 44 through 47, is substantially the same as the embodiment of FIG. 16 except that the slats of the non-planar slat groups 2a in both side edges of the fin extend to portions adjacent heat transfer tube-mounting holes 5a, 5b adjacent longitudinally of the fin. The angles of the V-shaped cross-sections of the slats of the non-planar slat groups 2a are increased to assure that the fin 1 exhibits a sufficient stiffness even if the working of the louver is simplified by the omission of the bent sections 3' shown in FIG. 16 from the longitudinally central part.

Figure 36:
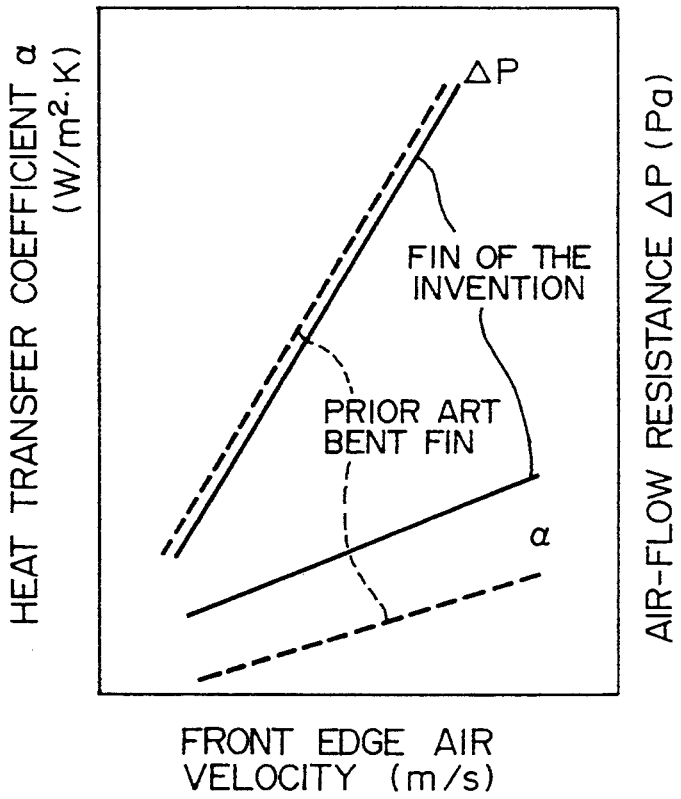
FIG. 36 is a graphic chart illustrating the performance of heat transfer and air-flow resistance of the fin.
Figure 37:
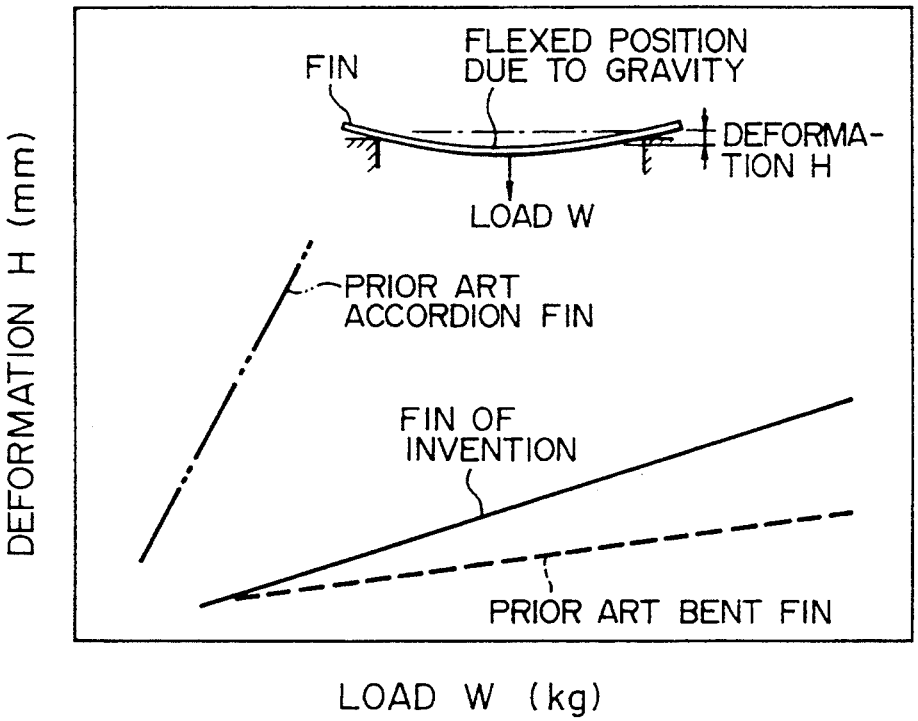
FIG. 37 is a graphic chart illustrating the stiffness of the fin.
Figure 38:
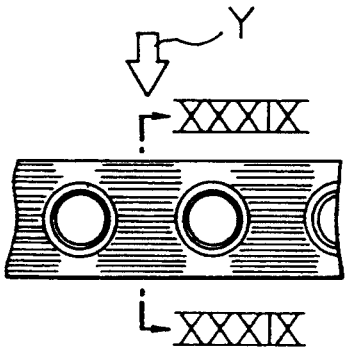
FIG. 38 PRIOR ART
FIG. 38 is a fragmentary plan view of the conventional fin.
Figure 39:
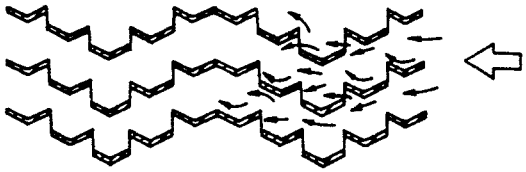
FIG. 39 PRIOR ART
FIG. 39 is a cross-sectional view taken along the line XXXIX—XXXIX in FIG. 38.
Figure 40:
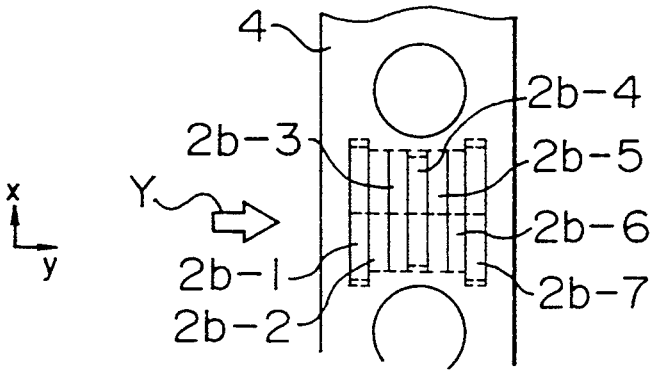
FIG. 40 PRIOR ART
FIG. 40 is a fragmentary enlarged plan view of the conventional fin shown in FIG. 38.
Figure 41:
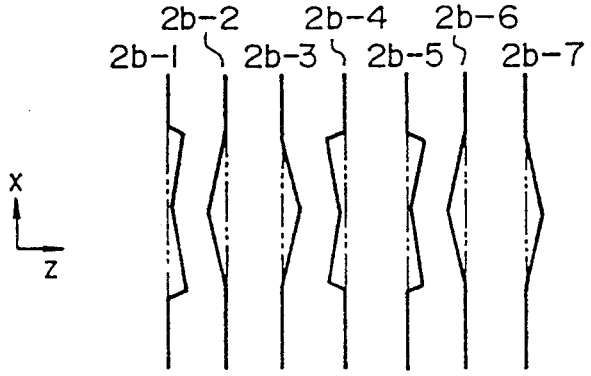
FIG. 41 PRIOR ART
FIG. 41 is a view similar to FIG. 4A but illustrates the configurations of slats of the louver central part of the conventional fin shown in FIG. 40.

FIGS. 36 and 37 are diagrams showing measured values of the performance of heat transfer, the air-flow resistance and the stiffness of a prototype to which the present invention is applied. The "bent fin" in the drawings implies a fin of the configurations shown in FIGS. 38 and 39. The "accordion fin" implies the prior art fin of the configurations shown in FIGS. 40 and 41. FIGS. 36 and 37 also show the results obtained from these conventional fins. As can be seen from FIG. 36, the heat transfer performance ($\alpha$) of the fin of the embodiment of the present invention shown in FIG. 7 is remarkably improved as compared with the conventional fins, and the air-flow resistance ($\Delta P$) is also reduced. Further, it has also been found that the relationship between load and deformation, i.e., the index of the stiffness, is substantially the same as that of the conventional bending fin as shown in FIG. 37 and is remarkably reduced than that of the conventional accordion fin.

Figure 42:
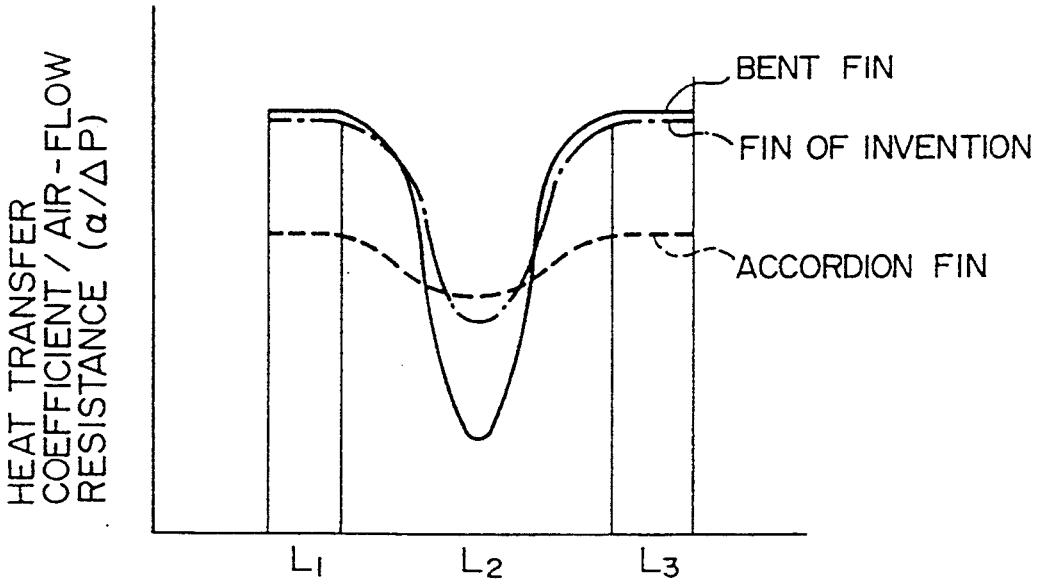
FIGS. 42 and 43 are graphic charts showing ratios of heat transfer factor/air-flow resistance of the conventional louver and of the louver of this invention.
Figure 43:
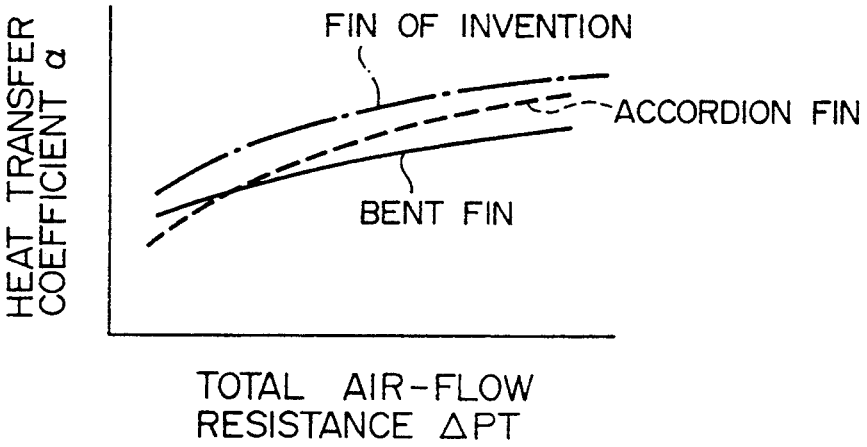
Figure 44:
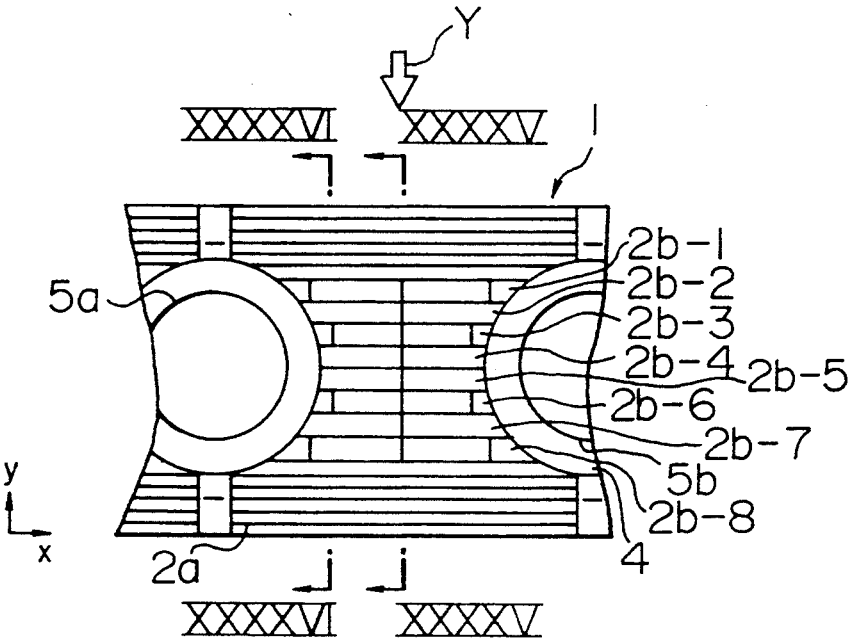
FIG. 44 is a view similar to FIG. 1 but shows a ninth embodiment of the fin according to the present invention.
Figure 45:
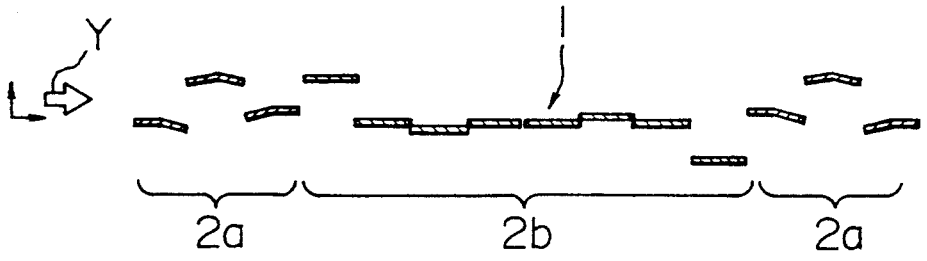
FIGS. 45 and 46 are enlarged cross-sectional views taken along the lines XXXXV—XXXXV and XXXXVI—XXXXVI in FIG. 44.
Figure 46:
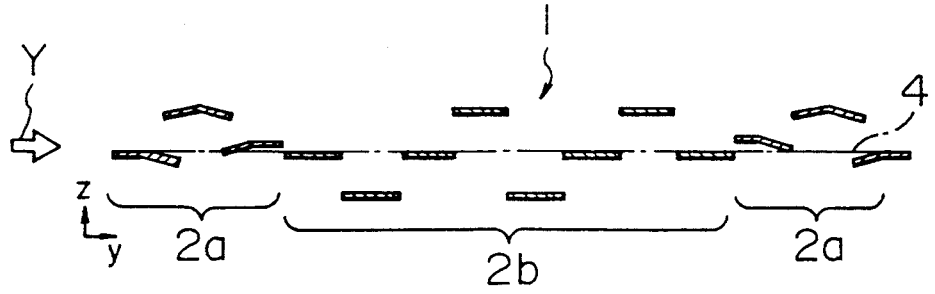
Figure 47:
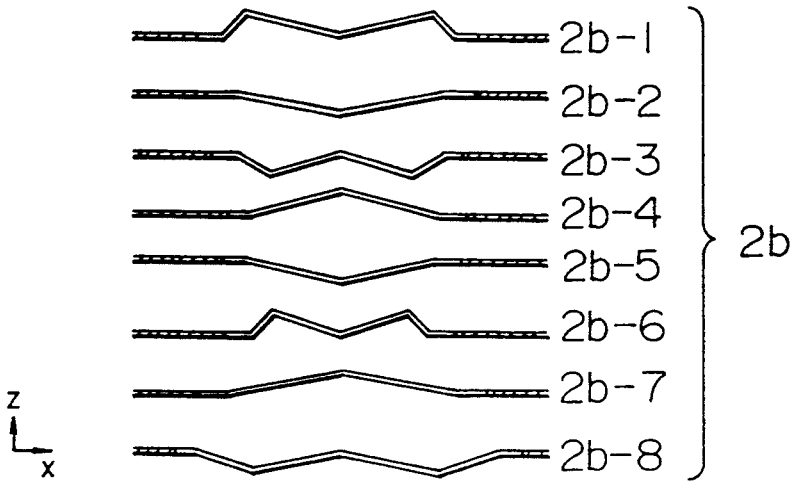
FIG. 47 is a view similar to FIG. 4A but illustrates the configurations of the slats of the louver central part of the fin shown in FIG. 44.

The reason for this lies in the fact that a ratio of the heat transfer coefficient $\alpha$ to the air-flow resistance $\Delta P$ changes in the widthwise direction of the fin according to variations in the flow velocity, as shown in FIG. 42. At both fin side edge sections $L_1$ and $L_3$ (see FIG. 1), the ratio $\alpha/\Delta P$ in the fin of this invention is higher than in the accordion fin having overlaps of the slats. This ratio is substantially the same as that in the bent fin. In the fin central section $L_2$ exhibiting a high flow velocity, however, the heat transfer coefficient with the bent fin is improved due to disturbance of the air flow. The air-flow resistance of the bent fin, however, increases more and resultantly the value of $\alpha/\Delta P$ is greatly decreased. Contrastingly, in the fin of this invention, the rate of reduction in the ratio $\alpha/\Delta P$ is small. Hence, as shown in FIG. 43, the ratio $\alpha/\Delta P_T$ for the entire width $(L_1+L_2+L_3)$ of the fin of this invention is higher than that of the fin having only a single kind of slats. It can be understood therefrom that the fin having a combination of slats of different configurations according to the present invention is more effective.

Regarding the stiffness, on the other hand, the utility range of the prior art accordion fin employed for a small-sized heat exchanger has hitherto been limited to a short fin. In contrast with this, the fin of this invention has a high stiffness and is therefore applicable to a long fin for a large-sized heat exchanger for which only the bent fins having a high stiffness have previously been usable.

What is claimed is:

1. A fin-tube type heat exchanger comprising:

at least two substantially parallel heat transfer tubes for a first heat-exchanging medium; and a stack of a plurality of elongated heat transfer fins mounted on said tubes in a heat transferring relationship;

each heat transfer fin comprising at least two substantially flat tube-mounting sections spaced in the longitudinal direction of said fin and extending substantially in a first plane perpendicular to axes of said heat transfer tubes, tube-mounting holes respectively formed in said tube-mounting sections, two bent side sections integral with each of said tube-mounting sections and extending between the tube-mounting section and the side edges of said fin, respectively, and a louver section disposed between said two tube-mounting sections and the associated bent side sections;

said heat transfer tubes extending through said tube-mounting holes, respectively;

each adjacent pair of said heat transfer fins cooperating to define therebetween a passage through which a second heat-exchanging medium is caused to flow across the widths of said fins in heat exchanging relationship with the first heat-exchanging medium flowing through said heat transfer tubes;

said louver section including a planar slat group extending between said two tube-mounting sections and a non-planar slat group disposed in side-by-side relationship with one of the side edges of said planar slat group and having longitudinal ends connected to the two bent side sections respectively associated with said tube-mounting sections;

said planar slat group including a plurality of elongated slats extending substantially in parallel with a line connecting axes of said two heat-transfer tubes and having side edges spaced from each other, each of said slats having a substantially planar configuration substantially parallel to said first plane, as viewed in a cross-section taken along a second plane perpendicular to said line connecting said tube axes and also perpendicular to said first plane;

said non-planar slat group including at least one slat having end portions each connected to one of the two bent side sections associated with one of said two tube-mounting sections and a longitudinal central portion connected to and disposed between said two end portions and having a generally V-shaped or inverted V-shaped configuration as viewed in a cross-section taken along a third plane parallel to said second plane;

each of said end portions being divided into a plurality of small slats by substantially parallel cuts extending longitudinally of said fin, each of said small slats having a generally V-shaped or inverted V-shaped configuration as viewed in a cross-section taken along said second plane; and each of said bent side sections having a generally V-shaped or inverted V-shaped configuration as viewed in a cross-section taken along a fourth plane parallel to said second plane.

2. The heat exchanger according to claim 1, wherein each of the slats of said planar slat group has a configuration protruding from said first plane, as viewed in a longitudinal section taken along a fifth plane parallel to said line connecting said tube axes and perpendicular to said first plane, and each adjacent pair of slats of said planar slat group have different longitudinal sectional configurations.

3. The heat exchanger according to claim 1, wherein the V-shaped or inverted V-shaped cross-sectional configuration of each of said bent side sections has a first peak offset from said first plane by a first distance which is different from a second distance by which a second peak of the V-shaped or inverted V-shaped cross-sectional configuration of said longitudinal central portion of the slat of said non-planar slat group is offset from said first plane.

4. The heat exchanger according to claim 1, wherein the V-shaped or inverted V-shaped cross-sectional configuration of each of said bent side sections has a first peak which is spaced from an associated side edge of said fin by a first distance which is different from a second distance by which a second peak of the V-shaped or inverted V-shaped cross-sectional configuration of said longitudinal central portion of the slat of said non-planar slat group is spaced from said associated side edge.

5. An elongated heat transfer plate fin for a heat exchanger of the type having at least two heat transfer tubes, the plate fin comprising:

at least two substantially flat tube-mounting sections spaced from each other in the longitudinal direction of said fin and respectively formed with tube-mounting holes for receiving said heat transfer tubes, said tube mounting sections extending substantially in a first plane perpendicular to axes of said tube-mounting holes;

two bent side sections integral with each of said tube-mounting sections and extending between the tube-mounting section and side edges of said fin, respectively; and a louver section disposed between said two tube-mounting sections and associated bent side sections;

said louver section including a planar slat group extending between said two tube-mounting sections and a non-planar slat group disposed in side-by-side relationship with one of the side edges of said planar slat group and having longitudinal ends connected to the two bent side sections respectively associated with said tube mounting-sections;

said planar slat group including a plurality of elongated slats extending substantially in parallel with a line connecting the axes of said tube-mounting holes and having side edges spaced from each other, each of said slats having a substantially planar configuration substantially parallel to said first plane, as viewed in a cross-section taken along a second plane perpendicular to said line connecting said tube mounting hole axes and perpendicular to said first plane;

said non-planar slat group including at least one slat having end portions each connected to one of the two bent side sections associated with one of said two tube-mounting sections and a longitudinal central portion connected to and disposed between the two end portions and having a generally V-shaped or inverted V-shaped configuration as viewed in a cross-section taken along a third plane parallel to said second plane;

each of said end portions being divided into a plurality of small slats by substantially parallel cuts extending longitudinally of said fin, each of said small slats having a generally V-shaped or inverted V-shaped configuration as viewed in a cross-section taken along said second plane; and each of said bent side sections having a generally V-shaped or inverted V-shaped configuration as viewed in a cross-section taken along a fourth plane parallel to said second plane.

6. The plate fin according to claim 5, wherein each of the slats of said planar slat group has a configuration protruding from said first plane, as viewed in a longitudinal section taken along a fifth plane parallel to said line connecting said tube mounting hole axes and perpendicular to said first plane, and each adjacent pair of slats of said planar slat group have different longitudinal sectional configurations.

7. The plate fin according to claim 5, wherein the V-shaped or inverted V-shaped cross-sectional configuration of each of said bent side sections has a first peak offset from said first plane by a first distance which is different from a second distance by which a second peak of the V-shaped or inverted V-shaped cross-sectional configuration of said longitudinal central portion of the slat of said non-planar slat group is offset from said first plane.

8. The plate fin according to claim 5, wherein the V-shaped or inverted V-shaped cross-sectional configuration of each of said bent side sections has a first peak which is spaced from an associated side edge of said fin by a first distance which is different from a second distance by which a second peak of the V-shaped or inverted V-shaped cross-sectional configuration of said longitudinal central portion of the slat of said non-planar slat group is spaced from said associated side edge.

* * * * *